United States Patent [19]

Cushing et al.

[11] 4,123,618

[45] Oct. 31, 1978

[54] VAPOR-COOLED TERMINAL-BUSHINGS FOR OIL-TYPE CIRCUIT-INTERRUPTERS

[75] Inventors: George B. Cushing, Penn Hills; Richard E. Kothmann, Churchill Borough, both of Pa.

[73] Assignee: Westinghouse Electric Corp., Pittsburgh, Pa.

[21] Appl. No.: 694,105

[22] Filed: Jun. 9, 1976

[51] Int. Cl.[2] ..... H01B 17/26; H01B 17/54; H01H 33/68; F28D 5/00

[52] U.S. Cl. ..... 174/11 BH; 165/11; 165/105; 174/15 BH; 174/15 HP; 174/143; 174/209; 200/150 R; 200/289

[58] Field of Search ..... 174/11 BH, 12 BH, 14 BH, 174/15 BH, 15 HP, 16 BH, 137 B, 142, 143, 152 R, 153 R, 179, 209; 165/11, 105; 200/150 R, 150 A, 289

[56] References Cited

U.S. PATENT DOCUMENTS

| | | | |
|---|---|---|---|
| 3,067,279 | 12/1962 | Baker | 174/15 BH X |
| 3,394,455 | 7/1968 | Grimmer | 174/143 X |
| 3,434,087 | 3/1969 | Hofmann | 260/37 EP X |
| 3,531,580 | 9/1970 | Foster | 174/152 R |
| 3,547,871 | 12/1970 | Hofm ann | 260/37 EP |
| 3,627,899 | 12/1971 | Moore | 174/15 HP X |
| 3,767,835 | 10/1973 | Engelhardt | 174/15 BH X |
| 3,828,000 | 8/1974 | Luck et al. | 260/37 EP |
| 4,005,297 | 1/1977 | Cleaveland | 165/105 X |

FOREIGN PATENT DOCUMENTS

| | | | |
|---|---|---|---|
| 692,340 | 8/1964 | Canada | 174/142 |
| 1,224,626 | 3/1971 | United Kingdom | 174/179 |
| 1,233,310 | 5/1971 | United Kingdom | 174/179 |
| 1,390,908 | 4/1975 | United Kingdom | 174/15 HP |

OTHER PUBLICATIONS

Anderson Electric Corporation Manufacturers' Catalog No. 57, Oct. 1, 1958, p. IV of Second Section (Section B).

*Primary Examiner*—Laramie E. Askin
*Attorney, Agent, or Firm*—W. A. Elchik

[57] ABSTRACT

An improved vapor-cooled terminal-bushing is provided for increased current-carrying capacity, such as 6,000 amperes, for example, in an oil-type circuit-breaker, being provided with a "dry" body portion, utilizing resinous materials, such as epoxy-resin formulations, for example.

Preferably, the body portion of resinous materials, such as epoxy resin, for example, is composite, or of a two-piece construction, having an inner first epoxy-resin formulation having improved dielectric strength, and an outer-disposed externally-located "petticoat"-type insulating second body portion, having weather-sheds, the second weather-shed annular body portion being preferably cast directly onto the inner high-dielectric-strength first epoxy-body portion, and having some flexibility for adherence purposes.

An externally-located tubular metallic preferably finned heat-exchanger or cooling condenser, having a tubular central hub portion, constitutes an extension of the inner, elongated, tubular, high-voltage terminal-lead, which is partially filled with a low-boiling-point cooling liquid or refrigerant, such as "Freon-11", for example. A massive metallic line-terminal connector is affixed to the terminal-lead intermediate the location of the heat-exchanger and the adjacent end of the body portion for additional heat-dissipation purposes. A pressure gauge is attached at the upper end of the heat-exchanger in vapor communication with the cooling liquid within the terminal-lead.

4 Claims, 19 Drawing Figures

FIG. 16.
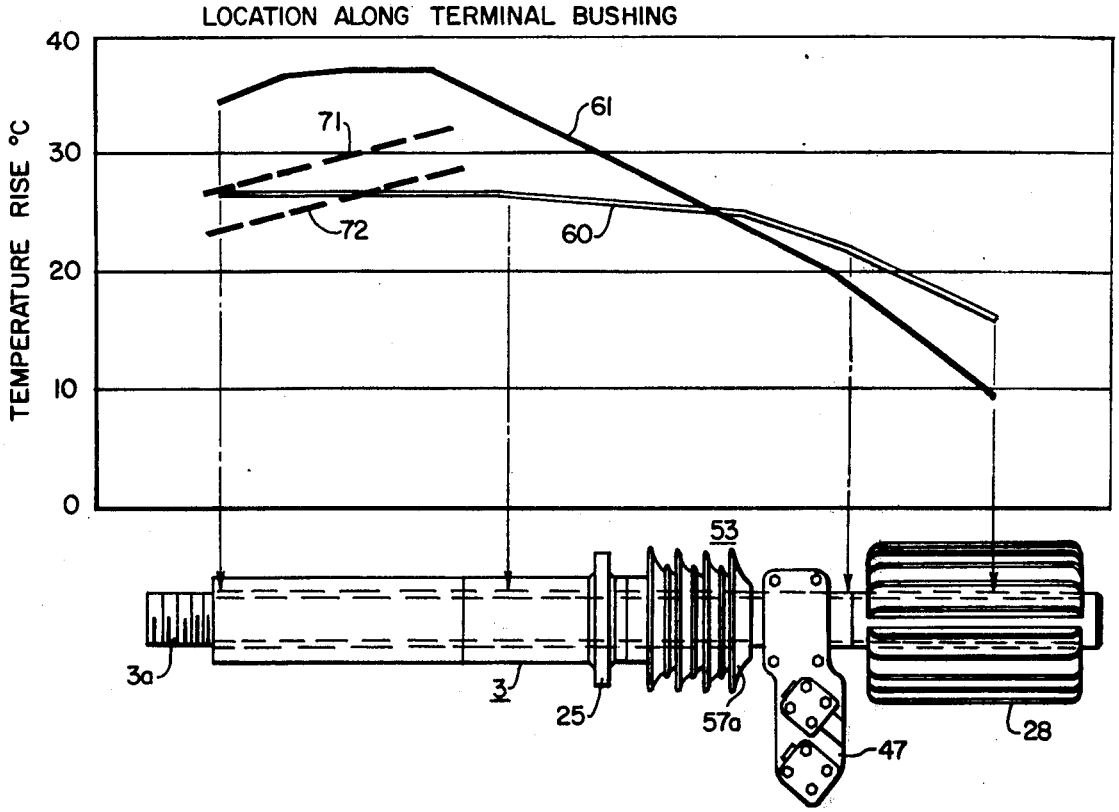
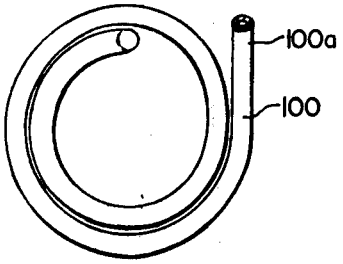
FIG. 18.
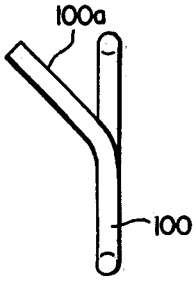
FIG. 19.
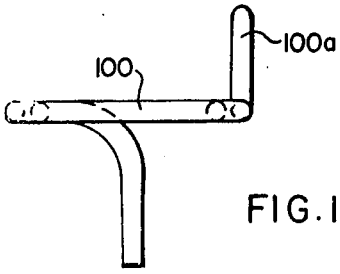
FIG. 17.

VAPOR-COOLED TERMINAL-BUSHINGS FOR OIL-TYPE CIRCUIT-INTERRUPTERS

CROSS-REFERENCES TO RELATED APPLICATIONS

Applicants are not aware of any related patent applications pertinent to the present invention.

BACKGROUND OF THE INVENTION

In U.S. Pat. No. 3,067,279, issued Dec. 4, 1962, to Benjamin P. Baker, there is illustrated and described a vapor-cooled bushing. The vapor utilized in the Baker bushing boiled and ascended as a vapor to a heat-exchanger disposed at the upper end of the Baker terminal-bushing, which was located externally of the oil-tank casing, which enclosed the interrupting structure. Heat, generated at the stationary contact, secured to the lower end of the Baker-cooled bushing, was transmitted to the vapor to be dissipated externally of the oil-tank structure, as well as the $I^2R$ losses generated within the terminal-lead itself. Also, Lapp-U.S. Pat. No. 2,953,629 issued 9/20/60 is of interest, as is Moore—U.S. Pat. No. 3,627,899, issued Dec. 14, 1971.

FIELD OF THE INVENTION

The present invention may be utilized in the circuit-breaker or transformer arts as a means of transmitting current interiorly into a surrounding enclosing metallic tank structure. As is well known by those skilled in the art, circuit-breakers, involving arc-extinguishing structures disposed within tank structures, either liquid or gas-filled, must have the line-current transmitted into the metallic tank structure to the arc-extinguishing structures by suitable means, which is insulated from the surrounding generally-grounded metallic tank structure. The terminal-bushing, as is set forth in the instant patent application, accommodates this important function.

Additionally, as is well known by those skilled in the art, terminal-bushings are utilized in the transformer art to carry current to the primary and secondary windings surrounding the magnetic core structure disposed internally within a generally-grounded metallic tank structure. Again, terminal-bushings are utilized in this type of equipment to transmit the heavy line-current to the internally-disposed transformer windings, such current, of course, being at the utilized high line voltage, necessarily having to be insulated from the grounded metallic tank structure.

SUMMARY OF THE INVENTION

In accordance with the present invention, a vapor-cooled terminal-bushing is provided having an externally-disposed metallic preferably finned heat-exchanger. Preferably also, the metallic heat-exchanger comprises a central tubular core, or hub member, which has direct vapor communication with the interior of the tubular terminal-lead, the latter, of course, transmitting the current through the terminal-bushing itself.

A suitable line-terminal is provided, preferably, although not necessarily, of massive configuration secured adjacent the upper end of the terminal-lead, and disposed, preferably, between the upper-disposed heat-exchanger, or condenser and the upper end of the vapor-cooled terminal-lead, so as to readily accommodate attachment to the external line-connection. The body portion of the terminal-bushing at least partially comprises an epoxy-resinous composition, which may be cast directly onto the inner-disposed metallic, elongated, tubular terminal-lead.

In a particularly desirable form of the invention, the resinous body-portion is of a composite, or two-piece construction, having an inner first resinous sleeve-portion, such as epoxy resin, for example, and a subsequently-cast-on outer second resinous annular shed member, such as epoxy resin desirably of some flexibility, for example, having "petticoats", or weather-sheds formed on the surface thereof, and thereby providing improved lengthened surface creepage paths between the high-voltage upper lead and the centrally-arranged grounded mounting flange. The inner epoxy-resinous formulation is particularly selected for its high-dielectric-withstand capability and also matching coefficient of thermal expansion compatible with that of the metallic lead. The externally-disposed outer weather-shed member, however, is particularly formulated to resist electrical surface tracking over the external, outer surface of the terminal-bushing, and possesses some flexibility for firm adherence with the inner first body portion.

A low-boiling-point liquid, such as "Freon-11", for example, at least partially fills the cavity of the inner tubular terminal-lead, and during operation of the equipment, boils or vaporizes as a result of the generated heat, and rises as a vapor to become subsequently liquefied, or condensed by heat transmission to the externally-disposed finned metallic heat-exchanger, or condenser.

BRIEF DESCRIPTION OF THE DRAWINGS

FIG. 16 is a graph of the profile of the terminal-bushing lead-temperature rises, showing the benefit of vapor-cooling at 4,000 amperes, with and without the benefit of vaporizable fluid cooling in the hollow terminal lead; and, FIGS. 17–19 are detailed views of the metallic tubing, which is employed to effect filling of the vaporizable fluid into the tubular terminal-lead, and which can subsequently be pinched off for fluid sealing purposes.

DESCRIPTION OF THE PREFERRED EMBODIMENT

Figure 2:
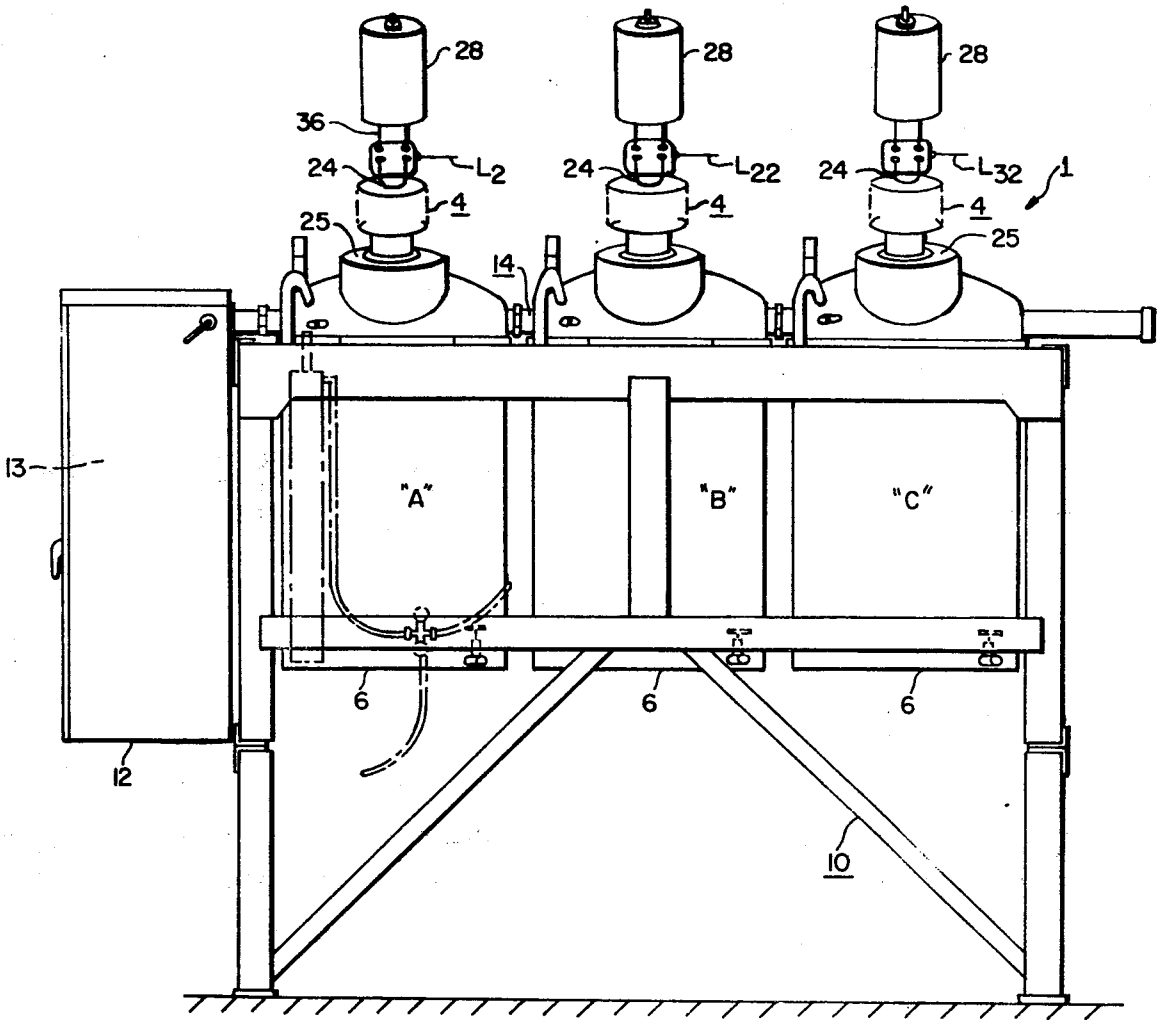
FIG. 2 is a side-elevational view of the three-pole, oil-type, circuit-interrupter of FIG. 1.
Figure 1:
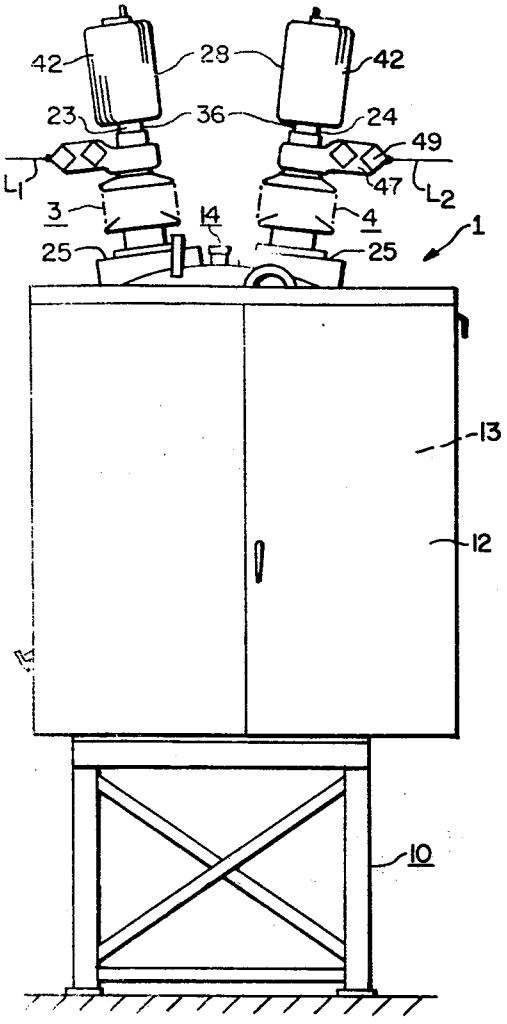
FIG. 1 is an end, elevational view of a three-pole, oil-type, circuit-interrupter assemblage embodying the principles of the present invention.

Referring to the drawings, and more particularly to FIGS. 1 and 2 thereof, the reference numeral 1 generally indicates a three-pole, high-voltage, oil-type, circuit-interrupter controlling the three phases $L_1$–$L_2$, $L_{21}$–$L_{22}$ and $L_{31}$–$L_{32}$ of an electrical transmission line. It will be observed that a pair of terminal-bushings 3 and 4 extend interiorly into each of the three metallic oil-tank structures 6 to carry current to a pair of interiorly-disposed arc-extinguishing structures 8, as more clearly illustrated in FIG. 3 of the drawings.

Figure 3:
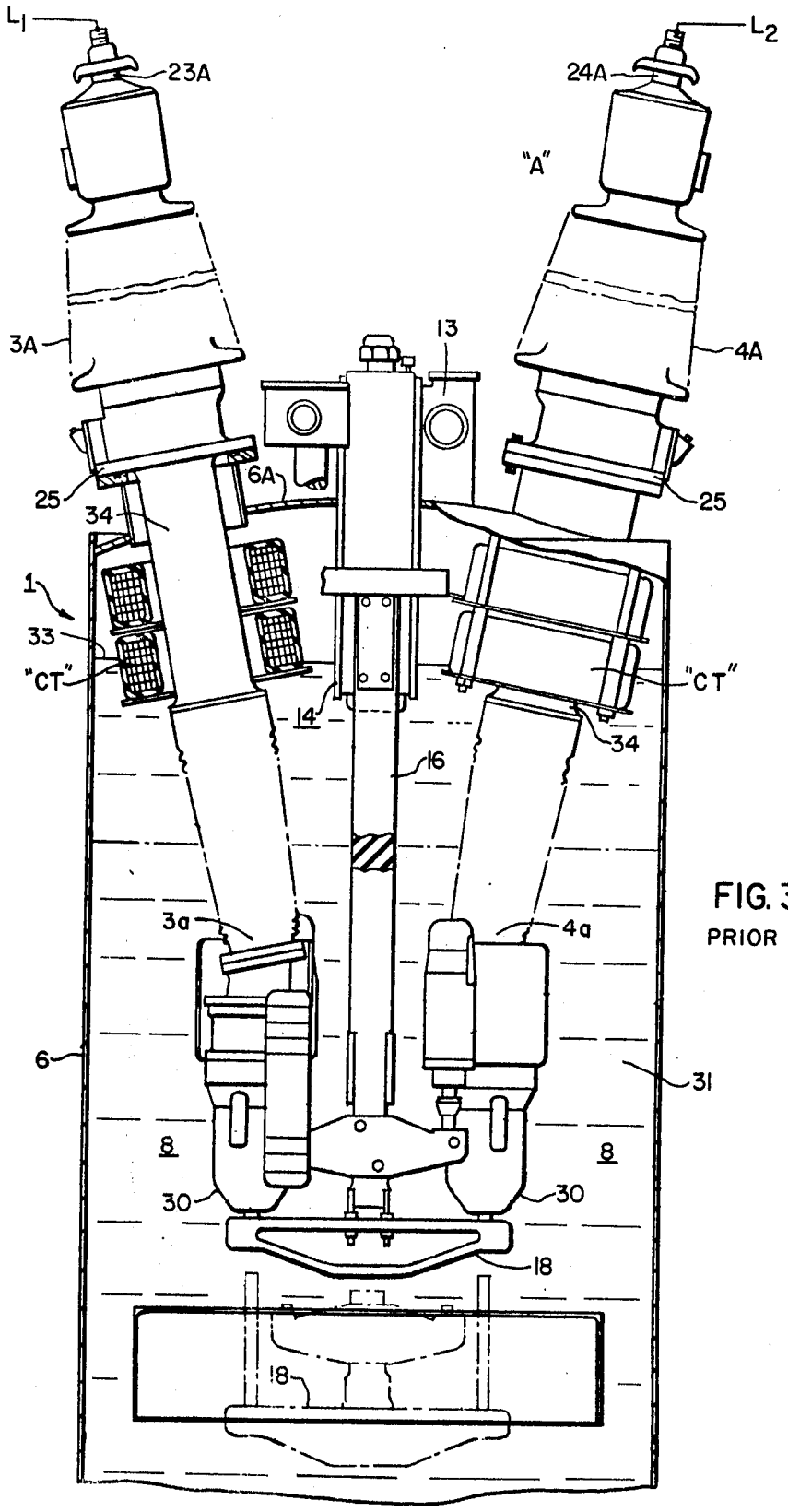
FIG. 3 PRIOR ART
FIG. 3 is a vertical sectional view taken through one pole-unit of an oil-tank structure of the prior art, illustrating the general environment for terminal-bushings of the present invention, and illustrating the associated internally-located pair of arc-extinguishing grid structures electrically interconnected by a cross-arm, or conducting bridging member, the device being shown in the closed-circuit position.

A lower supporting frame structure 10 is provided to support the three metallic tanks 6, and disposed at one end of the supporting frame structure 10 is a mechanism housing 12 enclosing a suitable high-speed operating mechanism 13, which, through bell-cranks and a suitable lever-linkage system 14 (FIG. 3), transmits vertical opening and closing motions to a plurality of insulating, vertically-arranged, lift-rods 16, as more clearly illustrated in FIG. 3 of the drawings.

Each vertical lift-rod 16 supports a movable horizontal bridging contact 18 at its lower end, as shown in FIG. 3, which electrically interconnects or bridges the two stationary contact structures (not shown), which are threadly secured and clamped to the lower interior ends 3*a*, 4*a* of the pair of conducting tubular terminal-leads 23, 24.

FIG. 3, showing the prior-art construction, more clearly illustrates the mounting and environment of each of the terminal-bushings 3A, 4A of the prior art by a metallic mounting flange 25, which is preferably formed of metal, such as aluminum, for example. The tubular conducting terminal-lead 23A or 24A, however, is preferably formed of copper, or aluminum, as desired, because of their desirable high thermal heat conductivity.

As well-known by those skilled in the art, the downward opening motion of each vertical lift-rod 16, as initiated by the leverage and linkage system 14, extending from the operating mechanism 13 (not shown in detail), causes the estabishment of two serially-related arcs within the insulating grid-plate structures 30, and a consequent vaporization of oil 31 occurs within each insulating grid-structure 30, causing thereby extinction of the arcs therein. Reference may be had to U.S. Pat. No. 3,356,811—Cushing et al. for a detailed description of the method of arc extinction within the oil 31, which constitutes no particular part of the present invention. It will, however, be observed that due to the stationary contact structures (not shown) carrying current, and since there is inherently a resistance drop in the terminal bushings 3A, 4A, $I^2R$ heat losses are, of course, generated within the terminal leads 23A, 24A, which must be dissipated. The level of the oil 31 within the metallic tank structure 6 of the prior art is indicated by the oil-level line 33.

Also, as illustrated in FIG. 3, exemplifying the prior-art constructions, there is provided a pair of current-transformers "CT" encircling the lower shank portion 34 of each terminal-bushing 3A, 4A to measure the current flow being transmitted, as well understood by those skilled in the art.

Figure 4:
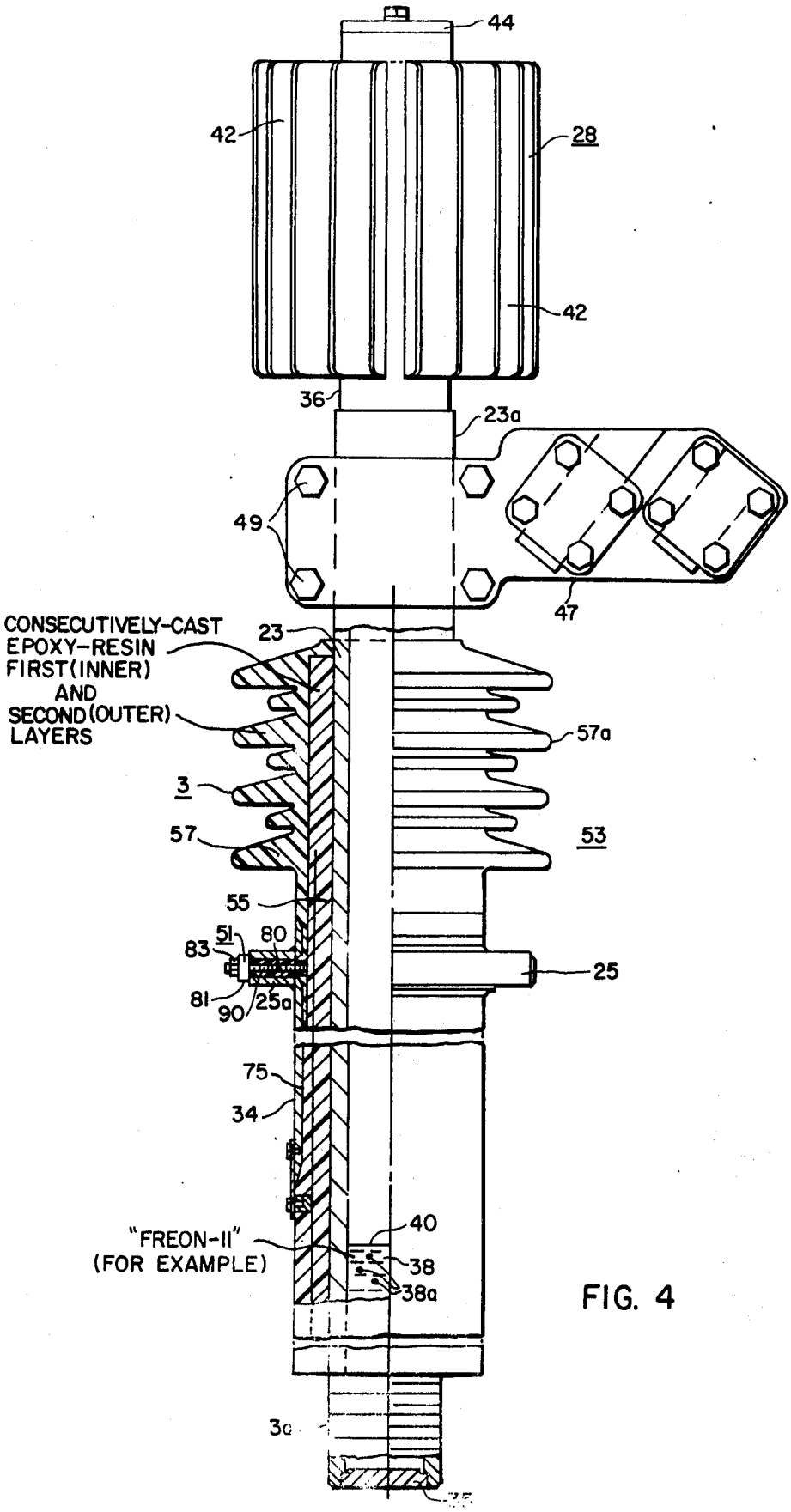
FIG. 4 is a detailed enlarged view of the improved terminal-bushing of the present invention, the view being taken partially in section.
Figure 6:
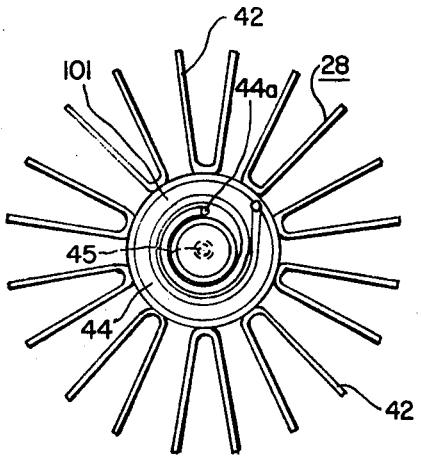
FIG. 6 is a top plan view of the heat-exchanger, or condenser of FIG. 5.

The present invention, however, is more particularly concerned with the construction of the novel high-voltage terminal-bushings 3, 4, as shown in FIG. 4, exemplifying the preferred embodiment of the present invention. It will be observed that each terminal-bushing 3, 4 comprises an inner, tubular, conducting lead 23, 24, preferably formed of copper, which has its lower end plugged, as by a closure plug-plate 35 (FIG. 4). The upper end of the tubular terminal lead 23 is open and threadedly intercommunicates with the tubular central hub-portion 36 of a metallic finned heat exchanger, or condenser 28, which is more clearly illustrated in FIGS. 4–6 of the drawings, and constitutes an important feature of the present invention. The tubular metallic terminal lead 23 of the present invention is filled with a low-boiling-point liquid, such as "Freon-11" 38, for example, to a level indicated by the reference numeral 40 in FIG. 4. Thus, as the temperature rises, due to the $I^2R$ heat losses occurring and generated within the tubular terminal lead 23, the inner vaporizable liquid 38 will boil, or vaporize, and the vapor bubbles 38*a* will thus rise upwardly and interiorly of the central hub-portion 36 of the upper-disposed heat-exchanger 28, where the heat will then be transmitted and dissipated to the outer ambient atmosphere.

Figure 7:
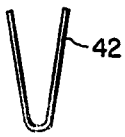
FIG. 7 is an end-elevational view of one of the plurality of metallic cooling clips, which are brazed, for example, to the body portion of the heat-exchanger.
Figure 8:
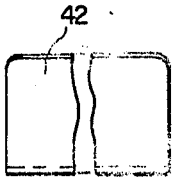
FIG. 8 is a side-elevational view of the metallic cooling clip of FIG. 7.

Preferably brazed to the external outer surface of the central tube, or hub 36 of the heat-exchanger 28 is a plurality of U-shaped metallic fin members 42, more clearly illustrated in FIGS. 7 and 8 of the drawings, which transmit the heat, generated within the terminal-lead 23 and hollow hub 36, to the outside atmosphere.

Figure 11:
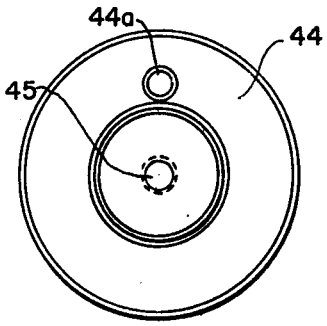
FIG. 11 is the top, plan view of the upper end plug of FIG. 10.
Figure 10:
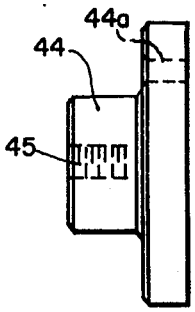
FIG. 10 is a side-elevational view of the upper plug-cap secured at the upper end of the hollow hub-portion of the heat-exchanger.
Figure 9:
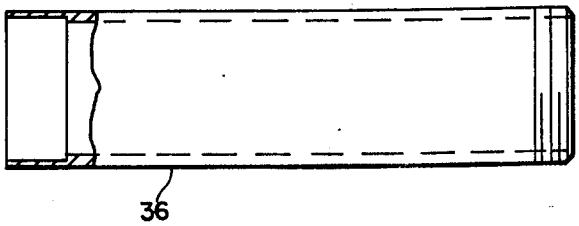
FIG. 9 is a longitudinal view, partially in section, of the hollow hub portion of the heat-exchanger.

The upper end of the central tube, or hub 36 of the heat-exchanger 28 is closed by an upper-disposed plug member 44, more clearly illustrated in FIGS. 10 and 11, and having a threaded bore 45 provided therein to permit mechanical raising of the terminal-bushing 3 or 4 by a threaded removable ring hook (not shown). The lower end of the tube, or hub 36, as mentioned, is open and threadedly interconnects with the upper open end 23*a*, or 24*a* of the respective terminal-lead 23 or 24, being hermetically soldered thereto.

A terminal connector 47 (FIG. 15) of bifurcated construction is clamped by a plurality of clamping bolts 49 to the upper end 23*a*, 24*a* of the respective tubular terminal-lead 23, 24, and is located at a position in between the heat-exchanger 28 and the terminal-bushing proper 3, as shown in FIG. 4.

The fluid level of the low-boiling-point liquid 38 within the tubular terminal-lead is indicated by the reference numeral 40 in FIG. 4. A power-factor tap connection 51 is provided on the side of the terminal-bushing body 3, and may be connected either to the aluminum mounting flange 25, or, alternatively, during power-factor measurements, may be connected to suitable external measuring equipment, as shown more clearly in FIG. 4.

"Freon-11" 38, for example, fills the inner tubular conductor 23 to the level 40 and is generally filled under a pressure of 2 P.S.I.G., for example.

The terminal-bushing body-portion 53 is of composite, or of a two-part structure, involving, preferably, sequential casting operations. First, the inner primary, or first condenser body-portion 55 is cast of a suitable resinous material, such as epoxy resin, for example, having a high dielectric strength, and preferably a matching coefficient of temperature expansion relevant to the terminal-lead 23. Preferably, also as a subsequent casting operation, a secondary externally-located weather-shed outer annular member 57, also formed from a suitable resinous preferably resilient material, is cast onto the upper outer external surface of the inner primary, or first condenser body 55, as indicated in FIG. 4.

The primary, or inner first resinous body-portion 55 has a possible formulation as set forth in IEEE Conference Paper C-74-064-2 by J. P. Burkhart and C. F. Hofmann, entitled "Applications of Cast Epoxy Resins in Power Circuit-Breakers", and also a desirable preferred formulation is set forth in Hofmann, U.S. Pat. No. 3,434,087.

The outer resinous weatherproof insulating body portion is preferably formed of a weather-resistant, nontracking resinous material, such as preferably a cycloaliphatic epoxy resin. Reference may be made in this regard, to U.S. Pat. No. 3,511,922, issued May 12, 1970 to W. Fisch et al., entitled "Electrical Insulator of Hydrophthalic Anhydride Cured Cycloaliphatic Epoxy Resins for Overhead Lines", teaching a possible formulation. Also reference may be had to United States patent application filed Jan. 30, 1974, Ser. No. 438,061, now abandoned by Charles F. Hofmann, Donald J. Martahus and Chester W. Upton entitled "Resinous Weather Casing for Electrical Apparatus", and assigned to the assignee of the instant patent application for a desired formulation.

Additional information may be obtained from U.S. Pat. No. 3,485,940 issued Dec. 23, 1969 to Perry et al., entitled "Post-Type Modular Insulator Containing Optical and Electrical Components". Moreover, reference may be had to British Pat. No. 1,224,626 for additional information.

A pamphlet entitled "Bakelite Cycloaliphatic Epoxides" published by the Union Carbide Company contains information and characteristics of cycloaliphatic epoxides, which offer excellent arc-track resistance and arc resistance, are lightweight and can economically be formed into large complex shapes. It is stated that there are no particular serious shrinkage problems.

Reference may additionally be had to Sonnenberg U.S. Pat. No. 3,001,005, issued Sept. 19, 1961, Kessel et al. U.S. Pat. No. 2,997,527, issued Aug. 22, 1961, U.S. Pat. No. 3,001,004, issued Sept. 19, 1961 to R. G. Black, U.S. Pat. No. 2,997,528, issued Aug. 22, 1961 to Kessel et al.; and Sonnenberg et al. U.S. Pat. No. 3,230,301, issued Jan. 18, 1966.

With particular regard being directed to the outer weatherproof casing 57, desirable formulations, as set forth in the aforesaid Hofmann et al. patent application Ser. No. 438,061, filed Jan. 30, 1974 (now abandoned), which application is incorporated herein by reference, the following information is submitted:

The outer weathershed cycloaliphatic resin casing 57 for increasing surface creepage distance between the upper and lower ends of the terminal-bushing is preferably composed of a casting composition of a cycloaliphatic epoxy resin having one of a variety of detail formulations resulting in insulating weathercasings with mechanical characteristics, which range from rigid to rather flexible structure, as listed in the Tables I and II set forth below:

TABLE I

PHYSICAL PROPERTIES OF CAST EPOXY FORMULATIONS FOR LAYER 57

| Physical Properties | | Rigid Cycloaliphatic | Flexible Cycloaliphatic |
|---|---|---|---|
| Tensile Strength, psi | 25° C | 6,000 | 3,340 |
| | 100° C | 2,800 | 470 |
| Tensile Modulus, psi | 25° C | 1,000,000 | 440,000 |
| | 100° C | 1,000,000 | 9,000 |
| Tensile Elongation, % | 25° C | .27 | 2.2 |
| | 100° C | .30 | 5.4 |
| Flexural Strength, psi | 25° C | 9,300 | — |
| | 100° C | 6,900 | — |
| Flexural Modulus, psi | 25° C | 1,000,000 | 10,000 |
| | 100° C | 800,000 | — |
| Compressive Strength | 25° C | 20,000 | 10,000 |
| psi | 100° C | 13,000 | — |
| % Compression - Creep 1100 psi at 105° C after 300 hours | | .22% | — |
| Izod Impact Strength | 100° C | 0.5 | 1.62 |
| ft/lb/in notch | −40° C | 0.7 | 0.3 |
| Heat Distortion Temp. (D-648-264 psi) | | 150° C | <25° C |
| Coefficient of Thermal Expansion $X10^{-6}$ in/in/° C | | 45 | 100 |
| Specific Gravity | | 1.70 | 1.68 |

TABLE II

BLENDS OF CYCLOALIPHATIC EPOXY RESINS FOR LAYER 57

(Parts by Weight)

| Description | Formulas Rigid | Formulas Flexible |
|---|---|---|
| Cycloaliphatic resin A and/or | 15–20 | 4–8 |
| Cycloaliphatic resin B | 5–10 | 15–25 |
| Anhydride Hardener (Hexahydrophthalic) | 15–20 | 10–15 |
| Filler (Alumina Trihydrate) | 50–60 | 50–60 |
| Accelerator (Benzyldimethyl | 0.18–0.30 | 0.18–0.30 |

TABLE II-continued

BLENDS OF CYCLOALIPHATIC EPOXY RESINS FOR LAYER 57
(Parts by Weight)

| Description | Formulas Rigid | Flexible |
|---|---|---|
| Amine) | | |

The casting compositions vary with decreasing and increasing flexibility.

After casting, the modules are subjected to a curing temperature of about 100° C. for from 4 to 6 hours, after which they are given a post cure at 135° C. for 6 or 8 hours.

With regard to the inner resinous insulating body 55, this is particularly selected for its desirable high-dielectric-strength characteristics, and also matching coefficient of temperature expansion characteristics with the terminal-lead 23, 24. Any suitable such characterized resinous material may be selected, as is well-known by those skilled in the art, and in particular, a desirable epoxy resinous material having a high-dielectric-strength and adaptable for the inner insulating resinous body is U.S. Pat. No. 3,434,087, issued Mar. 18, 1969 to Charles F. Hofmann, and assigned to the assignee of the instant patent application.

The second outer weathershed body-portion 57 is preferably formed of a suitable resinous material having high surface tracking resistance, and preferably resilient in characteristics, and is cast as a subsequent operation over the primary inner body-portion 55. A possible formulation of the secondary, or second weathershed outer body portion is set forth in the aforesaid application Ser. No. 438,061 now abandoned.

FIG. 4 illustrates, on an enlarged scale, the composite body-portion 53 of the present invention, indicating the interface between the primary and secondary resinous body portions 55 and 57.

We are aware of prior-art patents, such as the Grover W. Lapp U.S. Pat. No. 2,953,629, issued Sept. 20, 1960, and Benjamin P. Baker U.S. Pat. No. 3,067,279. Both of these patents relate to an outer porcelain bushing-body, and not to a cast-epoxy bushing of the type set forth herein. The cast-epoxy bushing 3, as set forth in the instant patent application, has the advantage that considerable cooling of the surrounding oil 31 within the tank structure 6 is accomplished. There is, consequently, an unusual opportunity to accomplish this cooling action exerted upon the contained oil 31 with the use of epoxy insulation, since the thermal conductivity of epoxy resin is about twice as good as "Kraft" paper. Also, since the dielectric strength of the epoxy resin is greater by about 40 percent, the thickness of the insulation upon the terminal-lead 23, 24, dipping or immersed into the surrounding oil body 31 within the tank 6 can be reduced by 30 percent, facilitating thereby the flow of heat from the surrounding oil 31 into the terminal-lead 23, the latter being, of course, cooled by the aforesaid refluxing action.

Although the foregoing patents describe clamped porcelain constructions with compression springs, as in the case of the Baker patent, the instant disclosure describes a solid cast-epoxy resin bushing 3, 4, for which epoxy resin forms the primary insulation. The Baker patent uses convection, and not radiation as the primary mode of heat removal from the heat exchanger.

The heat exchanger, or condenser 28, described in the instant disclosure, is actually of a much higher capacity (16 sq. ft. area, for example) than units mentioned in the aforesaid Baker patent. This was intentionally planned, so that the heat exchanger, or condenser 28 and the terminal-lead 23 will operate effectively at a temperature below the temperature of the top, or upper oil 31 within the surrounding grounded metallic oil tank 6.

It is to be noted, furthermore, that oil dielectric within the terminal-bushing is described in the Baker patent, whereas our invention contemplates a dry "oil-less" construction of terminal bushing.

Accordingly, objectives of the improved terminal-bushing construction 3, 4 of the instant patent application, as set forth in FIG. 4, contemplate the following: (1) Remove heat from the heat-sink that is comprised of the upper volume of oil 31 within the tank 6, limited by standards to 80° C. maximum temperature; (2) Remove heat indirectly from the lever system components 14, CT's, and other oil-immersed elements subject to the intense electromagnetic field near the current path; and (3) Provide an isothermal heat-flow conduit between the interior contact foot (not shown) at 70° to 80° C. and the exterior heat exchanger 28 to minimize thermal stresses in the surrounding solid insulation 53.

In the above formulation of patent application Ser. No. 438,061, now abandoned, a description of resins "A" and "B" is additionally set forth in U.S. Pat. No. 3,828,000, issued Aug. 6, 1974 to Luck and Gainer, and assigned to the assignee of the instant patent application.

It will be noted that the inner epoxy-resin body 55 should be selected so that it has a matching coefficient of temperature expansion relevant to the inner metallic conducting tubular terminal-lead 23 of the terminal-bushing 3. This is desirable so that there will not occur any relative temperature expansion and contraction, and thus voids will be avoided. Obviously, voids should be eliminated as much as possible, as they tend to precipitate voltage breakdown. With regard to the outer, weatherproof, insulating, epoxy-resin layer, or body 57, here it is desired to cause adherence between the outer epoxy-resin body 57 and the inner previously-cured epoxy-resin body 55. Accordingly, some flexibility of the outer epoxy-resin body 57 is desired, and component resin "A" above in patent application Ser. No. 438,061, now abandoned namely product "ERLA 4221" of Union Carbide Corporation is a desired flexibility component. As mentioned, however, both of these component resins "A" and "B" are set forth and described in the aforesaid Luck and Gainer U.S. Pat. No. 3,828,000.

As an example of the important resultant cooling features of the present invention, attention is directed to FIG. 16 of the drawings, which shows the profile of the terminal-bushing lead 23 temperature rises, showing the benefit of vapor cooling at 4,000 amperes. The test conditions were as follows: With fluid charge 38 within the hollow terminal-bushing lead 23, the temperature line 60 indicates a lower temperature rise, in degrees centigrade, than the line 61, which shows alternate conditions of the terminal-lead 23 with the fluid charge 38 drained therefrom. It will be noted, comparing the two bushing-lead temperature-rise curves 60, 61, that the terminal lead 23 with the fluid charge 38 is at an appreciably lower temperature rise than the curve 61 of the same bushing terminal-lead 23 with the fluid charge 38 drained therefrom, as in the conventional "dry" construction of terminal-bushings.

In other words, when no vaporizable fluid 38 is present, as in the conventional "dry" construction, a thermal gradient develops along the conductor lead 23, the shape of which depends upon how well the conductor lead 23 is insulated against radial heat losses, and what the temperatures are at the upper and lower ends of the terminal lead 23. In this instance, the "hot-spot" temperature stabilized at 37° C. above ambient temperature. Heat flowing into the oil 31, surrounding the lower end of the terminal-bushing lead 23, raised its maximum temperature to 32° C. above ambient temperature.

The temperature line 71 is the temperature of the oil 31 surrounding the terminal bushing with no fluid charge 38 therein. The lower temperature line 72 is also the temperature of the oil 31 immediately surrounding the terminal bushing 3 with an adequate fluid charge 38 therein.

The foregoing tested equipment related to an epoxy-insulated 23 K.V. apparatus terminal-bushing 3, which, utilizing the features of the instant invention, has been operated in increased current capability from 4,000 amperes to 6,000 amperes by the changes in design, as proposed by the instant invention. Both the cross-sectional area of the tubular conductor lead 23 and the overall diameter of the terminal-bushing 3 are identical to the 4,000 ampere design. However, a finned heat exchanger 28 has been added at the upper end, as shown in the terminal-bushing construction of FIG. 4 showing an embodiment of the present invention.

The remarkable lowering of temperature, as indicated in FIG. 16, has been achieved by injecting a few liters of fluid 38 into the evacuated, hollow, tubular, central terminal-lead conductor 23. The fluid, preferably, should have a moderate vapor pressure and a high heat-of-vaporization, e.g. "Freon R-11" refrigerant, methanol, or water, to name a few. The obvious change, a vapor-to-air heat-exchanger has been added to dispose of internal $I^2R$ losses, which increases 2¼ times with increased continuous current.

FIG. 16 shows the effectiveness with which the refluxing coolant fluid 38 removes heat losses, as graphically illustrated in the curves in FIG. 16. The data are confined to two 4,000-ampere heat runs, one with the coolant fluid 38, and the other without the coolant fluid 38.

When the terminal-lead 23 is charged with fluid 38 under identical load conditions, its temperature profile is essentially isothermal. The maximum temperature rise stabilizes at approximately 26° C. As a consequence, the transfer of heat into the surrounding body of oil 31 is reduced, and the oil temperature stabilizes at a lower temperature level, as indicated in curve 72. Reflux cooling transports the heat losses at high velocity to the upper-disposed heat exchanger 28, from which they are dissipated into the surrounding ambient air. The resulting low and uniform operating temperatures obviously promote long operational installational life of the terminal-bushing 3, and reduce the entire temperature-operating conditions of the electrical equipment 1, which utilizes the terminal-bushings 3, 4.

An important feature of the present invention is the fact that the temperature of the surrounding body of oil 31 adjacent the lower end **3*a* of the terminal-bushing 3, that is, the oil into which the terminal-bushing 3 is submerged, is considerably dependent upon the cooling conditions associated with the terminal-bushing 3 itself. In other words, with a fluid charge 38 within the hollow terminal-lead 23, the temperature of the adjacent surrounding body of oil 31 is considerably lower than the temperature of the same oil 31 surrounding a terminal-bushing, in which the fluid charge 38 has been drained, as indicated by curve 72 in FIG. 16**.

A voltage-tap connection device 51 is provided for either making a power-factor test upon the terminal-bushing 3, or to apply ground potential to an inner metallic cylindrical foil member 75, which thereby eliminates voids and imposes the ground potential upon an inner cylindrical metallic imbedded foil member 75, actually within the insulating bushing body 55. In more detail, a cylindrical aluminum foil member 75, say, for example, 21⅜ inches × 16.25 inches, and 2 mils thick, as shown in FIG. 4, is encapsulated, or imbedded within the first primary inner insulating bushing body-portion 55, as shown in FIG. 4. Making electrical contact and extending radially inwardly into said cylindrical foil member 75 is a conducting stud 80, more clearly shown in FIG. 4. A thumb-nut 81 is threaded onto the outer end of the conducting stud 80, and an additional nut 83 is threaded over the thumb-nut, also as shown in FIG. 4 illustrating the present invention.

Preferably, the inner end of the conducting stud 80 is threadedly inserted and thereby electrically connected to a boss, the latter being connected by a shunt to contact with the external surface of the electrical cylindrical foil member 75, so as to make good electrical contact with the foil member 75. Additionally, there may be utilized one or more layers of glass cloth to strengthen the bushing body 55.

As mentioned hereinbefore, the external end of the power-factor tap 51 may be connected either to the ground mounting flange 25, or when making power-factor measurements, may be alternatively connected to suitable power-factor measuring instruments (not shown) during maintenance periods.

The mounting flange assembly 25 may be provided with an accommodating bore **25*a* to receive the power-factor stud 80, the latter, of course, being electrically insulated from the inner surface of the bore, provided through the metallic flange 25, by an insulating sleeve portion 90, which is integrally formed with the first, or inner primary insulating resinous body-portion 55**.

Figure 12:
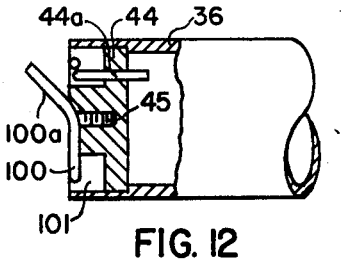
FIG. 12 is a fragmentary sectional view showing the assembly of the upper filling plug within the tubular hub portion of the heat-exchanger.

The technique for evacuating, filling with low-vapor-pressure fluid 38 and sealing may easily be accomplished: The process of charging with fluid 38 is carried out through a connection at the left end shown in FIG. 12 of the drawings. Here a spiral of ¼ inch copper tubing 100 (FIG. 18) is recessed in a pocket 101 within the left end of the heat exchanger 28. The right end of the small tube 100 passes through a hole **44*a* in the sealing plug 44 and into the interior of the hub pipe 36, which is to receive the fluid charge 38. The left end 100*a* is bent upward to facilitate attachment to the evacuation and charging equipment (not shown). After the charge has been introduced, the exposed end 100*a* of the tube 100 is pinched closed, as in refrigeration practice, effecting a pressure weld, which is expected to be gas-tight. As a further precaution, solder (not shown) is flowed into the tube 100** outboard of the pinched seal.

Improved protection has been provided for the filling features to shield them from the weather and from tampering by the recess 101. The plug 44, has been completely redesigned to provide the aforesaid recess 101 to accommodate the filling tube 100, and to provide a blind tapped hole 45 for the lifting eye, or the cover bolt (not shown).

From the foregoing description, it will be apparent that there has been provided a "dry-type" terminal-bushing 3 combining epoxy insulation 53, a fluid-charge lead 23 and a heat-exchanger 28 to dispose of heat losses. The fluid-charged lead 23 operates isothermally to minimize differential thermal expansion and the stresses it would impose on the epoxy-resin insulating system 53. Also, the fluid-charged lead 23 and the heat-exchanger 28 are designed to carry rated load at a uniform temperature of approximately 68° C., thereby avoiding stresses associated with high temperature. Also, importantly, the terminal-bushing system 3 includes the heat-exchanger 28 designed to throw off a major part of the breaker heat-losses into the outside atmosphere, externally of the oil-tank structure 6. The improved self-cooled terminal-bushing 3 (FIG. 4) of the present invention is additionally arranged to minimize the critical flange diameter by operating the terminal-lead 23 at abnormally high-current density, and using low-loss, high-dielectric-strength epoxy-resin material 53 as primary insulation between the terminal-lead 23 and the outer-disposed ground flange 25.

Additional information regarding resins in general may be obtained from a "Handbook of Epoxy Resins" by Henry Lee and Kris Neville, published by the McGraw-Hill Book Company, copyright 1967, which in chapters 2 and 4 gives additional information. Information regarding suitable fillers may also be obtained in U.S. Pat. No. 3,547,871, issued Dec. 15, 1970, to Charles F. Hofmann, entitled "Highly-Filled Casting Compositions", which gives considerable information regarding suitable fillers to avoid cracks, or voids occurring when the elongated terminal stud 23, 24 is encapsulated in the resin so that the thermal rate of expansion of the resin may be somewhat similar to that of the terminal stud 23, 24.

Also, U.S. Pat. No. 3,531,580, issued Sept. 29, 1970, to Newton C. Foster provides information on weather-resistant epoxy resins, particularly epoxy novolac resin having weather-resistant properties. This patent teaches an outer polyester resinous weather-resistant coating, or layer on an inner epoxy resin bushing body having desirable characteristics. The chemical formulas are set forth in this U.S. Pat. No. 3,531,580.

It is, of course, desirable to have the thermal expansion of the metallic terminal stud 23 compatible, and not much different with the inner insulating epoxy-resinous primary bushing body 55.

Figure 13:
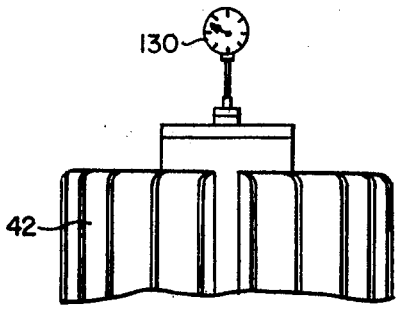
FIG. 13 illustrates the use of a pressure gauge in vapor communication with the vaporizable fluid disposed within the hollow terminal-lead for temperature-measurement purposes.
Figure 14:
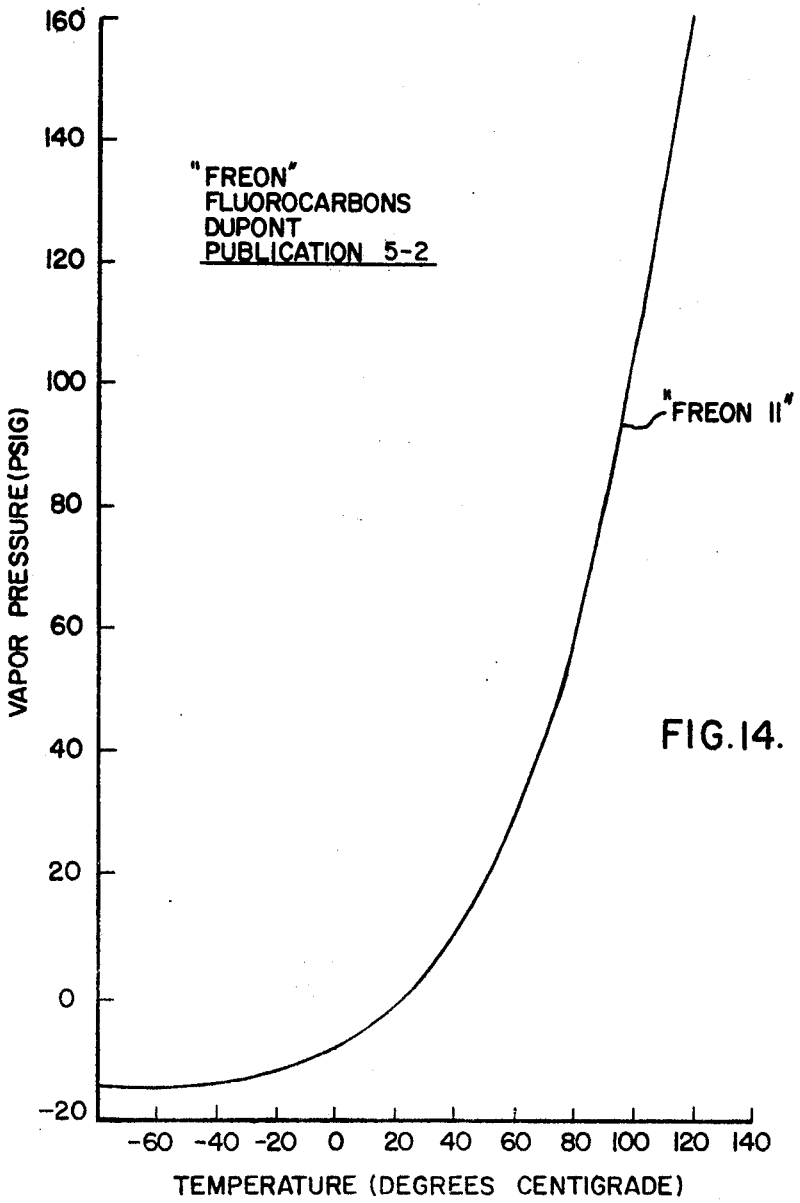
FIG. 14 is a graph of pressures, as read visually on the pressure gauge of FIG. 13, as a function of the terminal-lead temperature.

With our disclosure, the use of a compound pressure gauge 130 (FIG. 13) to monitor the internal pressure of the "heat pipe" 23 is contemplated. The operating temperature of the conductor 23 may be determined within a degree or two by reading the gauge pressure 130 (FIG. 13) through binoculars, and referring to the vapor-pressure curve for the cooling fluid, in this instance "Freon R-11" refrigerant, as shown in FIG. 14. By this means the user gains unprecedented insight relating to the internal temperature conditions of the terminal-bushing 3 that is particularly useful during short-term-overloads.

Another feature, which is obtained in our invention, as shown in FIG. 4, is the position of the electrical connector 47 (FIG. 15) directly above the weathershed structure 57*a* and beneath the heat-exchanger 28. At this particular location, the electrical connection $L_1$ or $L_2$ is made to the bushing conductor 23 in an area that is actively cooled by the internal refluxing fluid 38. Accordingly, local heating, originating in this relatively-massive, heat-sink connector 47, will be effectively cooled by vapor travelling into the heat exchanger 28. Conversely, with the aforesaid Lapp construction, U.S. Pat. No. 2,953,629, the electrical connection is made to a stub end of the electrical conductor, which, if warm, could not by refluxing action move its heat into the heat exchangers.

The location of the electrical massive metallic connector 47, as described above, also minimizes the length of the current path through the terminal-bushing 3 and related apparatus. Since the resistive losses are directly related to the length of this path, the close connection, as in this invention, will help to minimize these losses.

The pressure gauges 130 (FIG. 13) are visible at the top of each bushing 3, 4 and read pressures appropriate for the temperature of each of the respective bushing conductors 23, 24. As a secondary function, a partial vacuum appropriate for the vapor pressure of the fluid 38 charged into the conductor 23, 24 is read on these gauges 130 (FIG. 13) whenever the apparatus 1 is carrying no current, and the temperature falls to the ambient level. The existence of a vacuum under this condition assures a tight sealed system.

Figure 15:
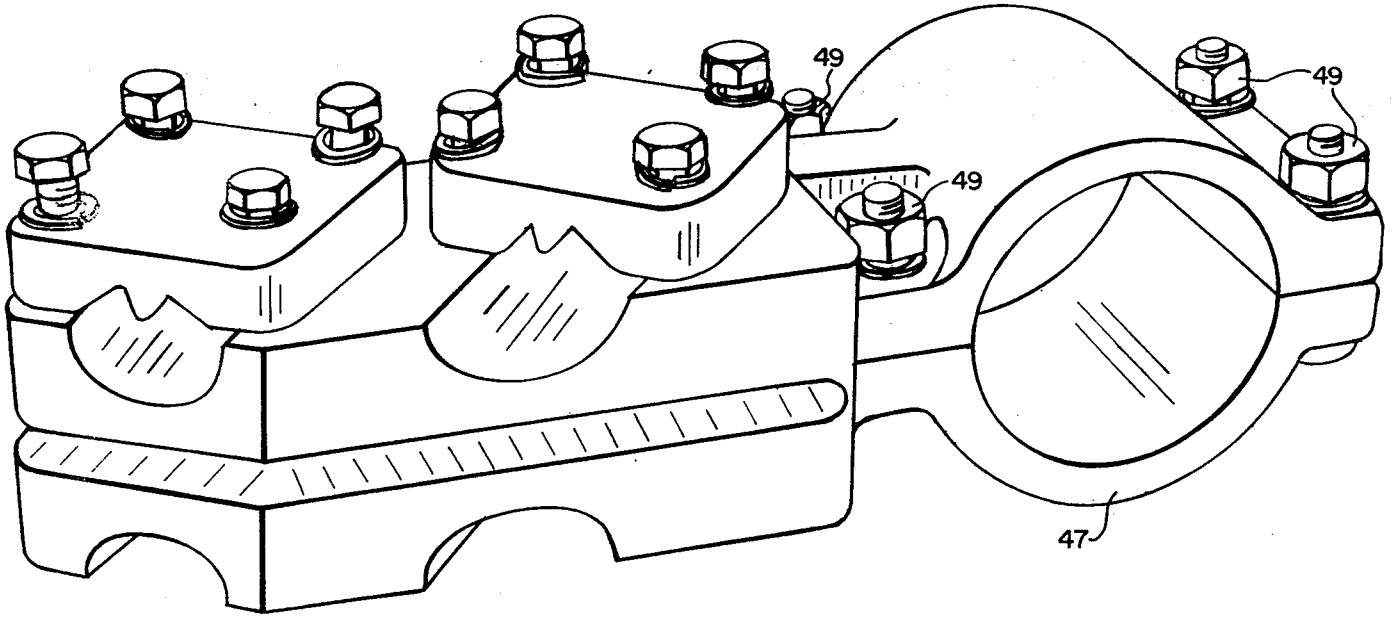
FIG. 15 is a perspective view of the massive heat sink constituting the terminal connector attached adjacent the upper end of the improved terminal-bushing of the present invention, and yet disposed below the heat-exchanger.

Special massive metallic terminal connectors 47 serving as "heat sinks" were designed for this specific application. The high-conductivity terminal connector 47, suitable for 6,000 ampere service, is not commercially available. The one shown in FIG. 15 is cast, for example, from "Cupaloy" material. It is designed to accommodate 4–2 million circular mil cables.

A terminal-bushing which will dispose of its own thermal losses extends the rating of generator voltage (14.4 kV) oil circuit-breakers to a continuous current of 6,000 amperes, as shown in FIG. 4. Since these heat losses can constitute one third of the total heat generated within a pole-unit "A", "B" or "C", removing them by the direct means of an integral heat exchanger 28, as illustrated in FIG. 4, provides latitude for increasing the continuous-current rating of the equipment 1 (FIG. 1) without exceeding permissible operating temperatures.

Insulation of thoroughly tested, reliable, epoxy formulations 53 gives desirable simplicity to the terminal-bushing structure 3, 4. A two-part insulating resinous system 53 comprised of a homogeneous, bisphenol core 55 and a subsequently cast-on, cycloaliphatic weathershed 57 provides excellent physical properties including weatherability and track resistance under outdoor conditions.

Advantages in interchangeability are realized by manufacturing the 6,000 ampere terminal-bushing 3, 4 to the identical assembly dimensions of the existing 4,000 ampere unit. Also, by following this pattern, one can expect to duplicate most of the well-established voltage withstand characteristics, insofar as external strike distances in air and internal strike distances in oil are concerned. Maintaining the same diameter below the mounting flange 25 would be particularly advantageous because, as installed in the circuit-breaker 1, this region extends through toroidal current-transformers, "CT", the diameter of which largely determines the size of the breaker pole-unit structure.

Standard oil circuit-breakers 1 rated 14.4 kV, 1500 mva, as shown in the prior-art construction of FIG. 3, have been available for many years to serve at generator voltages. Continuous-current ratings of 3 kA and 4 kA are listed; however, higher non-standard ratings are offered by a few manufacturers in more complex designs that are consequently more expensive.

The desirability of a 6 kA rating in the simple, compact oil-type circuit-breaker configuration 1 became apparent with the development of large, gas-turbine-powered generating stations. Protection and control of an output of 150 mva would be within the capacity of such a circuit breaker 1. Also, the ability to perform switching at generator voltages would offer flexibility and economy in the control of station service power.

Considering the design parameters of a 6 kA oil circuit-breaker 1, it became apparent that most features of the classic construction could be continued if one could develop a self-cooled terminal-bushing 3, 4, no larger physically than the 4 kA bushing of the prior art of FIG. 3, and providing otherwise for 50% more current. The current-transformers "CT", which surround the terminal-bushings 3, 4 beneath the pole-unit metallic cover 6A, would be larger because a 6000/5 ratio is necessary and requires proportionally more turns. This could be taken care of by canting the terminal-bushings outwardly an added degree and enlarging the oil tank two inches, to a 32-inch diameter, to provide clearance at the gasket seat adjacent to the lower transformer. The thermal losses that are attributed to inductive heating would be minimized through selective use of non-magnetic steel in the tank 6 and lever system 14, and by using aluminum alloy in the fabrication of the pole-unit bases (tank-top assemblies).

The key to achieving a bushing with a 6 kA rating within the dimensional limitations of the 4 kA structure was to internally cool the central, tubular, copper lead 23, 24 by refluxing an inert volatile liquid 38. The liquid 38 would be vaporized within the lead 23, 24, extracting its heat of vaporization. The vapor would travel upwardly to the gas-to-air heat exchanger 28 formed as a lead extension at the top. Here the heat-of-vaporization would be surrendered to the heat exchanger 28 and transferred from it to the outside air. The vapor would then condense and drain back to the bottom of the terminal lead 23, 24 where the vaporization cycle would begin again.

According to one aspect of the present invention, it is proposed to use a completely enclosed and self-contained vapor-cooling system, in which some liquid, with a low boiling point and a high heat of vaporization, is used to carry the heat from its source near the center of the bushing conductor tube to a radiating surface at the end of the bushing. The following liquids possess the desired characteristics: ethyl ether, methyl formate, methyl or acetaldehyde, or propane. These liquids all have a high heat of vaporization and a boiling point between 20° C. and 35° C. at atmospheric pressure. By varying the applied pressure, the boiling point of the refrigerant liquid can be raised or lowered, as desired.

Ammonia, which is generally used as a refrigerant, is inexpensive and has a high heat of vaporization, but its boiling point is a −33° C. If it is desired to bring its boiling point up to a suitable value, such as 55° F., 100 p.s.i. absolute pressure would be required. In the event the temperature rose to 158° F., the enclosing parts of the bushing would have to withstand internal pressures in excess of 400 p.s.i. For some applications, this would be undesirable.

As volatile liquids suitable for evaporative cooling, one may use chloro-fluoro derivatives of ethane and methane, for example trichloromonofluoromethane, known under the trade name of "Freon 11" and trichlorotrifluoroethane, known under the trade name "Freon 113." These and other possible refrigerant liquids are listed below, together with their boiling point at atmospheric pressure:

| Trade Name | Formula | B.P. at 1 Atm., ° C |
|---|---|---|
| Freon 11 | $CCl_3F$ | 23.7 |
| Freon 21 | $CHCl_2F$ | 8.9 |
| Freon 113 | $C_2Cl_3F_3$ | 47.7 |
| Freon 114 | $C_2Cl_2F_4$ | 3.5 |
| Name: | | |
| Methylene chloride (dichloro) methane), $CH_2Cl_2$ | | 40.1 |
| Perfluoromethylcyclohexane | | 76.3 |
| Perfluorotriethyl amine | | 71. |
| Perfluorobicyclo-(2.2.1)-heptane | | 70 (746 mm.) |

Preferably, the pressure is so adjusted that the liquid will boil at a selected temperature, at which it is desired to operate the contact structure or the terminal bushing.

It will be observed that the evaporative cooling system of the present invention is arranged wholly within the terminal bushing structure and takes up very little more space than would be required in a conventional bushing. Preferably the volatile liquid has a freezing point well below any ambient temperature at which it is desired either to store the terminal bushing or to operate it in service. No auxiliary operating mechanism, pumps, or special heat exchangers are required.

An important fact to note is that since the refrigerant liquid is disposed within conducting structure, all at the same potential, such as the hollow conductor stud 23, the dielectric strength of the produced vapor is unimportant.

Preferably, the pressure employed with the selected volatile liquid is such that the boiling point of the volatile liquid, when in operating use, is within the temperature range from 40° C. to 90° C.

The terminal-lead temperature should not exceed a total temperature of 90° C., where it is in contact with the oil 31 used in the circuit-breaker tank 6. Preferably, it should operate below 80° C., so that heat would be extracted from the oil mass 31, which normally should be stabilized at less than 80° C.

The terminal-bushing proper of our invention, with heat exchanger 28, is shown in FIG. 4. The diameter of the terminal-lead 23, 3.75 inches, for example, is somewhat less than that employed in the 4 kA structure. The reduction was made to increase the annular space available for the cast epoxy insulation 53, which centers the terminal lead 23, 24 in the metallic tube 34 forming the bore of the ground-potential mounting flange 25. The copper cross-section is 5.1 square inches, for example. Its effective length of 48 inches produces an a-c resistance of 8.2 micro-ohms at 85° C. At a current level of 6 kA, a loss of 295 watts would be generated within each terminal-bushing.

A tubular concentric metal foil 75 has been imbedded in the epoxy insulation 55 at a diameter ¼ inch inside the center mounting flange 25. This serves a dual purpose. When connected to the flange 25 at ground potential, it shields voids at the mounting flange to the epoxy interface, which might otherwise produce ratio interference. Disconnected, it provides an electrode for measuring power factor and losses to the terminal lead 23, 24. A link (not shown) interconnects foil 75 and flange 25.

Figure 5:
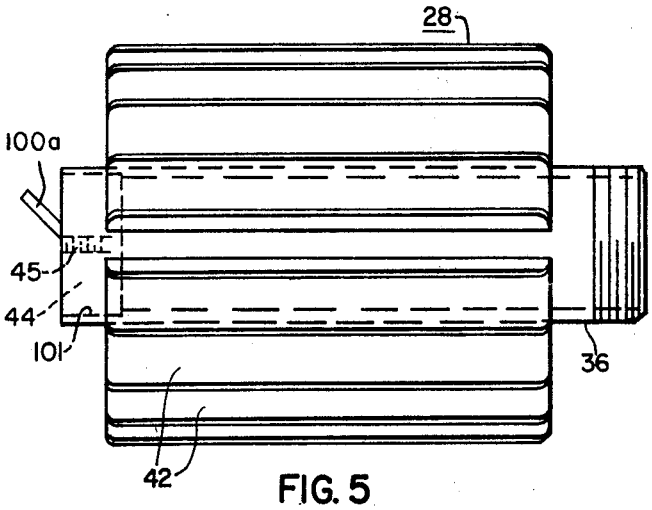
FIG. 5 is an enlarged side-elevational view of the heat-exchanger, or condenser utilized at the upper end of the terminal-bushing structure.

The heat exchange 28, shown in FIG. 5, is manufactured preferably of copper with vertical fins 42 furnace-brazed with a high-temperature brazing alloy about a central tubular hub 36. Processing temperatures anneal the copper and, consequently, the fins 42 can be easily distorted. Notwithstanding, copper was selected from among candidate materials because of its high thermal conductivity and brazeability.

Calculations predicted that the fin surface area of 16 square feet, for example, would be more than ample to dissipate the 295 watt losses of the terminal bushing 3, 4. Load tests were run on the first heat exchanger 28 manufactured. A rise above ambient of 28° C. proved sufficient to dissipate the 295 watts.

The distinct advantage of reflux cooling 38 within the terminal bushing lead 23, 24 is that the lead 23, 24 itself will operate at a uniform temperature and within a few degrees of the fin temperature. If all the terminal bushing losses are routed through the fins 42 and the ambient air is, in fact, the standard 40° C., the terminal lead would operate at approximately 68° C! Standards accept lead and terminal temperatures up to 105° C. except where special cable insulation is involved.

This may be compared with a tubular copper lead, relying upon the thermal conductivity of copper for heat extraction and without integral reflux cooling. One would expect the hottest spot to be about mid-length in the lead 23, 24. Assuming the distributed losses move axially toward both ends along the lead 23, 24, the necessary temperature gradient for equilibrium would raise the hot-spot temperature 32° C. above the temperature of the two ends. Unidirectional heat flow of this magnitude from bottom to top would be an unacceptable hypothesis since it would produce a top-to-bottom temperature difference of 131° C.

In practical 14.4 kV bushings 3, 4, where the required electrical insulation does not greatly impede radial heat flow, a portion of the losses will be conducted outward through the flange 25 and to the breaker top 6A, from which it will, in turn, be dissipated. However, in the present instance of a 6 kA rating, the heat dissipation capacities of the usually available surfaces are loaded by the losses arising elsewhere and are not available for bushing cooling.

Temperature runs on two new bushings 3, 4 according to FIG. 4, were made with the units installed in an experimental breaker pole unit of the 6 kA rating. Conditions were as tabulated below:

| Run No. | Current | Duration | Special Conditions |
|---|---|---|---|
| 1 | 4 kA | 13.5 hrs. | None |
| 2 | 6 | 17 | None |
| 3 | 7 | 5 | None |
| 4 | 4 | 17 | Fluid Absent |

Run #1, 4000 Amperes

This run stabilized with the bushing lower end surrounded by 47° C. to 52° C. oil 31 and the upper end in ambient air at 24° C. The lead temperatures were sensed with eleven thermocouples imbedded in the copper surface during manufacture. All lead temperature measurements fell within a 24° C. to 26° C. rise above the air ambient. The upper oil temperature 31 was a degree or two higher than the lead temperature indicating heat flow from the oil 31 into the lead 23, 24 at a rate probably not exceeding 5 watts per bushing.

Run #2, 6000 Amperes

At the conclusion of this run, the oil temperature 31 surrounding the lower end of the bushing was in the 67° C. to 80° C. temperature range and the upper end was in ambient air at 25° C. Lead temperatures had stabilized at a temperature rise of 49° C. to 50° C. above the air ambient. The maximum internal pressure was 49 psig. A temperature difference of 6° C. existed between top oil 31 and lead 23, 24 which should cause heat flow from the coil radially into the bushing of perhaps 20 watts per bushing.

The top oil temperature 31 of 80° C. was the maximum likely to be encountered in a breaker application. Accordingly it was gratifying to observe upper terminal temperatures at 70° C. Had the air ambient been the standard 40° C., terminals would have been no higher than 85° C.; whereas 105° C. is acceptable. That these values exceed earlier predictions is attributed to greater-than anticipated heat flow being channeled through the bushings. Contacts attached to the lower ends are the principal sources.

RUN #3, 7000 Amperes

A foreshortened run was conducted at 7 kA to explore temperature conditions under overload. After 5 hours with an air ambient of 27° C. the oil 31, surrounding the bushing 3, 4, had reached temperatures ranging from 60° C. to 80° C. The lead itself registered a 53° C. to 54° C. temperature rise. The maximum internal pressure was 59 psig. It is apparent that a load cycle from zero load to 117% rating can be endured for several hours by the reflux cooled bushing with no serious consequence.

Run #4, 4000 Amperes, Fluid Absent

A 17 hour run was completed at 4 kA after draining the coolant 38 from the lead 23, 24. This was to explore emergency conditions and limitations of the new bushing when partially incapacitated by loss of fluid.

Conditions had stabilized at the conclusion of the run. The oil 31 surrounding the lower part of the bushing 3, 4 was in the 46° C. to 56° C. range; the air ambient to which the upper end was exposed was 24° C. The lead temperatures had stabilized at 28° C. to 36° C. above ambient with the higher temperatures being at the lower end, and the upper end being cooled by conduction to the fin structure. A 4 kA load, when the bushing lacks the fluid charge, does not impose undue thermal stress on the pole unit or bushing structure.

ELECTRICAL TEST PROGRAM

The electrical requirement for the primary insulation of 14.4 kV power circuit breakers is a 110 kV basic insulation level (BIL). However, in many instances 23 kV bushings are furnished for added security. The new 6 kA bushing was tested at both levels in ascending order per standard:

| | 60 Hertz 1-Min | | Impulse | | |
|---|---|---|---|---|---|
| | | | Full | Chopped Wave | |
| | Dry | Wet | Wave | 2 μsec | 3 μsec |
| 110 kV BIL | 50 kV | 45 kV | 110 kV | 140 kV | 130 kV |
| 150 kV BIL | 70 | 70 | 150 | 195 | 175 |

All but one of the above applied voltages were withstood successfully. The exception, the 60 Hz wet test at 70 kV, was marginal; however, a wet test level of 65 kV could be satisfied without question.

Power factor measurements on a production run of bushings fall within a 0.18% to 0.26% range, further substantiating the desirable low values reported by others.

From the foregoing description, it will be apparent that there has been provided an improved terminal-bushing 3, 4, particularly adapted, for example, to a 6,000 ampere rating and a 14.4 kV voltage application. A homogeneous-filled epoxy resin 55 comprises the primary insulation between the coaxial tubular lead 23, 24 and the supporting flange 25. An outer cast-on weather casing 57 of suitable epoxy composition seals the structure for outdoor application and provides a track-resistant surface.

Unique means are employed to dissipate thermal losses. A finned heat exchanger 28 (FIG. 5) is provided at the top of the bushing designed to dissipate $I^2R$ losses of the lead 23, 24 when carrying rated load. Heat flow upward at minimum thermal gradient is effected by charging the heat exchanger 28 and lead assembly 23, 24 with an inert fluid 38 of low vapor pressure. The structure is hermetically sealed at the factory.

Two units were installed in a pole-unit of the circuit-breaker, and subjected to thermal tests at representative current levels. Actual temperatures, temperature rises and internal pressures were measured over the period necessary to achieve stable conditions. Approximately 60 thermocouples were monitored during this run. Performance was also studied briefly at 38% overload.

Standard voltage withstand tests, commensurate with the 150 kV BIL level, were also performed on sample units. Radio influence tests and endurance tests were carried out at significantly higher voltage than service conditions.

The unique application of reflux cooling 38 and an epoxy insulating structure 53 permitted a high strength terminal bushing 3, 4 to be designed more compactly than otherwise possible. The small diameter at the mounting flange 25 allowed a smaller, lighter-weight oil circuit-breaker to be evolved for the 6,000 ampere continuous current rating for 14.4 kV service interrupting short circuits up to 1,500 mva.

Formerly, solid copper leads 23, 24 were used. The core copper does not significantly lower than a-c resistance compared with the same OD in 0.5 inch wall tubing. The thermal gradient lengthwise, however, would be significantly lower with the solid bar.

To present the lead 23, 24 of this disclosure for comparison, it is to be 3.75 OD $\times$ 2.75 ID copper tubing, a 5.1 square inch area, and will be operated at 6000 amperes. The working current density is to be 1175 amperes per square inch, whereas the design data tabulated above for a 5000 ampere conductor 23, 24 in the classical usage specifies 800 amperes per square inch.

Let us examine the elements which provide this new level of capability in the disclosed, evaporatively cooled bushing:

1. Lead Losses

Lead losses ($I^2R$) have been calculated to be 275 watts when carrying 6000 amp. A heat exchanger 28 is provided capable of transferring these losses to atmosphere when $\Delta$ T, the heat exchanger temperature rise above ambient, is only 28° C. Theoretically, it appears that the lead might operate at a uniform temperature of 68° C. if one assumes the standard, 40° C. ambient.

2. Heat-Pipe Effect

A reflux cooled bushing 3, 4 partially submerged in the oil 31 of the circuit breaker tank 6 will extract heat at a rate determined by the temperature gradient and thermal conductivity of the interfacing areas. Standards allow an operating temperature of 80° C. for the upper oil 31 in the tank 6. Thus, a temperature difference of 12° C. (80-68) can be available to flow heat toward the fluid in the core of the bushing 3, 4. Here, heat flow is enhanced through the use of homogeneous epoxy insulation 53 in lieu of greater thicknesses of less effective insulation required previously for electrical reasons.

It should be evident that even at the standard 40° C. ambient, more heat will be transferred into the heat exchanger 28 than just the bushing losses. The tubular lead 23, 24 and heat exchanger 28 may operate above 68° C. and closer to the 80° C. oil temperature, extracting an estimated 400 or more watts per bushing from the pole unit. The total losses of a pole-unit fully loaded have been estimated at less than 1500 watts. If each of the two bushings 3, 4 disposes of 400 watts, less than 700 watts remain to be radiated and convected from the tank 6 and tank-top structure 6A.

Overload Features

The capacity of the heat exchangers 28 has been discussed based upon a 40° C. ambient in still air. Many applications of these buildings 3, 4 will be at ambients lower than 40° C. Also, fans can be directed at the heat exchangers 28 for further cooling if overload is encountered.

Flange Diameter 25

The bushing dimensions have a very important influence on the size of a circuit-breaker 1. Particularly important is that diameter which projects into the tank 6 and through the torroidal shaped current transformers "C.T.". The design disclosed here carries 6000 amperes in its lead and is insulated with a margin of at least 43% for the 150 BIL level. All this is accomplished with the above critical diameter no more than 6 inches. The combination of working the lead 23, 24 at high-current density, insulating with low-loss, high-dielectric-strength epoxy and extracting losses (heat) by refluxing fluid makes this practicable.

A dry bushing 3, 4 of conventional construction would need a lead diameter of 5.25 inches if it were necessary to operate at the 800 ampere per square inch current density in accordance with older design criteria where special cooling was not provided. This would automatically increment the critical diameter of the flange from 6 to 7.5 inches. Larger current transformers, larger tanks and larger tank tops would be a necessary consequence.

Thermal Gradient

The isothermal performance of the fluid charged conductor 23, 24 affords a superior means of removing heat losses from the equipment 1. The $I^2R$ losses of the conductor 23, 24 and losses from other sources totaling 400 watts can be transferred via the heat exchanger 28 to the ambient air, as previously described, with no significant gradient in the fluid charged conductor.

For this same power to flow by conduction in the 49 inches of copper conductor forming the lead 23, 24 a thermal drop of 387° C. would be necessary! In fact, limitations would arise at a power flow nearer 40 watts. The conductor temperature difference end to end for this load would be 38.7° C., consuming all but 1.3° C. of the allowable 40° C. between 80° C. oil and 40° C. ambient. The 1.3° C. at the fins would not be adequate to transfer the heat loss into the air.

Thermal Expansion

The epoxy resin 55 is designed to have a coefficient of thermal expansion reasonably matching the copper lead 23, 24 and the aluminum flange 25. Notwithstanding, it is desirable to avoid unnecessary thermal stresses. A lead 23, 24 with uniform temperature over its length controlled by the temperature and pressure conditions of the fluid 38 it contains will not impose differential stresses on the epoxy encapsulation 53 because of differential thermal expansion over its length. Likewise, a lead operating uniformly at 68° C. will avoid those stresses that arise under conventional usage where the lower terminal can be 80° C., and the upper one is allowed to rise to 105° C. Note that heat flow under these conditions is actually into the breaker.

Although there has been illustrated and described a specific structure, it is to be clearly understood that the same was merely for the purpose of illustration, and that changes and modifications may readily be made therein by those skilled in the art without departing from the spirit and scope of the invention.

We claim:

1. A high-amperage-current self-vapor-cooled terminal-bushing structure comprising, in combination: means defining a tubular sealed metallic terminal lead; volatile fluid means disposed within said tubular sealed metallic terminal lead; means defining an inner first layer of solid resinous insulating material cast directly around said terminal lead; means defining an outer second layer of solid resinous insulating material cast directly around and to the said inner first layer of solid resinous insulating material; said outer second layer having the characteristics of being somewhat flexible and in addition having weatherproof characteristics; means defining a heat-exchanger device (28) affixed to said tubular sealed metallic terminal lead and in vapor-communication therewith for effecting cooling liquefaction of heated vapor generated within the terminal lead; a mounting flange affixed adjacent the midportion of said outer second layer of solid resinous insulating material for supporting purposes; and a massive metallic line-terminal connector (47) affixed to the terminal lead intermediate the location of the said heat exchanger (28) and one end of the inner first resinous layer for additional heat-dissipation-purposes.

2. The combination according to claim 1, wherein a pressure gauge (130) is in vapor communication with the volatile fluid hermetically sealed within the tubular sealed metallic terminal-lead to enable maintenance personnel to visually measure the pressure registered on the said pressure gauge, and thereby determine the temperature level of the terminal-bushing lead and also additionally whether any fluid leakage therefrom exists.

3. A high amperage-current self-vapor-cooled terminal-bushing structure comprising, in combination: means defining a tubular sealed metallic terminal lead, volatile fluid means disposed within said tubular sealed metallic terminal lead; means defining a body of solid resinous insulating material cast directly around said terminal lead; means defining a heat-exchanger device (28) affixed to said tubular sealed metallic terminal lead and in vapor-communication therewith for effecting cooling liquefaction of heated vapor generated within the terminal lead; a mounting flange affixed adjacent the midportion of said body of solid resinous insulating material for supporting purposes; and a massive metallic line-terminal connector (47) affixed to the terminal lead intermediate the location of the said heat exchanger (28) and one end of the body of resinous insulating material for additional heat-dissipation purposes.

4. The combination according to claim 3 wherein a pressure gauge (130) is in vapor communication with the volatile fluid hermetically sealed within the tubular sealed metallic terminal-lead to enable maintenance personnel to visually measure the pressure registered on the said pressure gauge, and thereby determine the temperature level of the terminal-bushing lead and also additionally whether any fluid leakage therefrom exists.

* * * * *